US010753618B2

(12) United States Patent
Jördens et al.

(10) Patent No.: US 10,753,618 B2
(45) Date of Patent: Aug. 25, 2020

(54) HEATING ELEMENT ARRANGEMENT FOR A COOKING DEVICE, AND A COOKING DEVICE HAVING A HEATING ELEMENT ARRANGEMENT OF THIS TYPE

(71) Applicant: BSH Hausgeräte GmbH, Munich (DE)

(72) Inventors: Frank Jördens, Traunstein (DE); Jürgen Salomon, Trostberg (DE); Philipp Schaller, Traunreut (DE); Gerhard Schmidmayer, Bad Endorf (DE)

(73) Assignee: BSH Hausgeräte GmbH, Munich (DE)

( * ) Notice: Subject to any disclaimer, the term of this patent is extended or adjusted under 35 U.S.C. 154(b) by 205 days.

(21) Appl. No.: 15/780,246

(22) PCT Filed: Nov. 18, 2016

(86) PCT No.: PCT/EP2016/078102
§ 371 (c)(1),
(2) Date: May 31, 2018

(87) PCT Pub. No.: WO2017/102243
PCT Pub. Date: Jun. 22, 2017

(65) Prior Publication Data

US 2018/0372327 A1 Dec. 27, 2018

(30) Foreign Application Priority Data

Dec. 18, 2015 (DE) ..... 10 2015 225 928

(51) Int. Cl.
*F24C 7/04* (2006.01)
*F24C 7/06* (2006.01)

(52) U.S. Cl.
CPC ..... *F24C 7/046* (2013.01); *F24C 7/067* (2013.01)

(58) Field of Classification Search
None
See application file for complete search history.

(56) References Cited

U.S. PATENT DOCUMENTS 4,827,108 A * 5/1989 Balderson ..... H05B 3/748 219/543
6,069,345 A 5/2000 Westerberg
6,316,757 B1 11/2001 Kim et al.
(Continued)

FOREIGN PATENT DOCUMENTS

DE 10163087 A1 7/2003
DE 102007025082 A1 1/2009
(Continued)

OTHER PUBLICATIONS

International Search Report PCT/EP2016/078102 dated Jan. 12, 2017.
(Continued)

*Primary Examiner* — Thor S Campbell
(74) *Attorney, Agent, or Firm* — Michael E. Tschupp; Andre Pallapies; Brandon G. Braun

(57) ABSTRACT

A heating element arrangement for a cooking appliance includes a first heating zone which is constructed to emit IR radiation in a first wavelength range, and a second heating zone which is constructed to emit IR radiation in a second wavelength range. The first wavelength range and the second wavelength range differ hereby from one another.

20 Claims, 2 Drawing Sheets

(56) References Cited

U.S. PATENT DOCUMENTS

| | | | | |
|---|---|---|---|---|
| 6,333,492 | B1 * | 12/2001 | Graves | F24C 7/087 219/411 |
| 7,126,088 | B2 * | 10/2006 | Horton | F24C 7/082 219/412 |
| 7,800,023 | B2 * | 9/2010 | Burtea | A21B 1/02 126/92 AC |
| 8,929,724 | B1 | 1/2015 | Mograbi | |
| 10,085,592 | B1 * | 10/2018 | Cheng | A47J 37/0676 |
| 10,223,933 | B1 * | 3/2019 | Cheng | A47J 36/02 |
| 2005/0173400 | A1 * | 8/2005 | Cavada | F24C 7/04 219/411 |
| 2006/0051078 | A1 * | 3/2006 | Bonnin | H05B 3/0038 392/423 |
| 2006/0118983 | A1 * | 6/2006 | Cochran | A23L 5/15 264/40.6 |
| 2009/0301461 | A1 * | 12/2009 | Taplan | F24C 7/06 126/19 R |

FOREIGN PATENT DOCUMENTS

| | | | |
|---|---|---|---|
| DE | 102012014831 | A1 | 2/2013 |
| GB | 2274915 | A | 8/1994 |
| JP | H02152187 | A | 6/1990 |
| JP | 2010022625 | A | 2/2010 |

OTHER PUBLICATIONS

National Search Report DE 10 2015 225 928.5 dated Nov. 10, 2016.
National Search Report CN 201680074057.3 dated Mar. 1, 2019.

* cited by examiner

HEATING ELEMENT ARRANGEMENT FOR A COOKING DEVICE, AND A COOKING DEVICE HAVING A HEATING ELEMENT ARRANGEMENT OF THIS TYPE

CROSS-REFERENCES TO RELATED APPLICATIONS

This application is the U.S. National Stage of International Application No. PCT/EP2016/078102, filed Nov. 18, 2016, which designated the United States and has been published as International Publication No. WO 2017/102243 A1 and which claims the priority of German Patent Application, Ser. No. 10 2015 225 928.5, filed Dec. 18, 2015, pursuant to 35 U.S.C. 119(a)-(d).

BACKGROUND OF THE INVENTION

The present invention relates to a heating element arrangement, in particular a top-heat heating element, for a cooking appliance and to a cooking appliance having the heating element arrangement of this type.

PRIOR ART

Heating elements for cooking appliances, in particular tubular heating elements, which make a broad spectrum of infrared radiation (IR radiation) available to the grill process in a cooking appliance are known from the prior art.

A cooking appliance with a tubular heating element is known from DE 102007025082 A1, for instance, and is designed with an oven muffle which can be closed by an oven door, on the especially upper muffle wall of which at least one heating element, e.g. in the form of an electrical grill heating element, is disposed and the oven muffle is surrounded by an oven housing with the exception of the front panel.

The heating elements from the prior art are typically operated such that a specific radiation and thermal energy output by the heating element can be output to food which is disposed in the cooking compartment. This is often controlled by way of a timing device, in other words switching the corresponding heating element on and off.

The heating elements known from the prior art are in this respect disadvantageous in that only the total quantity of the radiation and thermal energy can be influenced and not the distribution or wavelength of the radiation.

The description of the prior art is provided in order to impart the understanding of the background of the present invention and can comprise subject matters and information outside of the prior art, which is known to the average person skilled in the art.

Object Underlying the Invention

One object of the present invention is to provide a heating element arrangement which is improved compared with the prior art and which eliminates the afore-described disadvantages, while retaining the advantages achieved from the prior art.

Inventive Solution

The solution of the set object is achieved by a heating element arrangement including a first heating zone designed to emit IR radiation in a first wavelength range, and a second heating zone designed to emit IR radiation in a second wavelength range. A heating element arrangement with two different heating zones can be understood to mean a two part arrangement.

In order to cook groceries in a cooking appliance, a distinction must be made above all between two processes involving the groceries, namely the heating and the browning. When working with IR radiation, a distinction can be made between these two processes by the absorption at two different atomic bindings. For the browning of the food, the C—H bindings in the food are decisive. Their main absorption is in the range 1165 cm−1, 1078 cm−1, 926 cm-1, 772 cm−1 and 740-650 cm−1 (vibrations in carbohydrates and nucleic acids). For heating the food, the O—H bindings are conversely decisive. Their main absorption is in the range 3700-2850 cm−1.

The fact that the heating element arrangement has a first heating zone for emitting IR radiation in a first wavelength range and a second heating zone for emitting IR radiation in a second wavelength range means that the grill process can be adjusted to foods. By designing the heating zones to emit IR radiation in defined wavelength ranges, it is possible for the bandwidth of the emitted radiation to be disposed primarily within the range of one of the main absorptions of the afore-cited bindings.

As a result it is possible to control the cooking and browning processes more precisely and the user could therefore be provided with various grill programs, for instance for meat, pastries or suchlike, which are optimized to a food. As a result, the efficiency of the grill would be clearly increased. Furthermore, the inventive heating element arrangement could also bring about a time and/or energy saving.

It shall be understood that the inventive heating element arrangement is an electrical heating element, which has electrical terminals for a power supply, said terminals being connected to a controller, circuit or suchlike, for instance, in order to operate the heating element.

Advantageous embodiments and developments which can be used individually or in combination with one another form the subject matter of the dependent claims.

According to one embodiment of the present invention, provision is made for the first wavelength range and the second wavelength range to be distinguished from one another. The fact that the first heating zone is designed to emit IR radiation in a first wavelength range and the second heating zone is designed to emit IR radiation in a second wavelength range which differs from the first wavelength range means that a more precise control of the cooking and browning process can take place, for instance. In other words, there is no overlap of the two wavelength ranges in this embodiment, as a result of which a more precise separation is permitted between the two processes mentioned.

According to a further embodiment of the present invention, there is provision for the first wavelength range to be in a range of 3700 to 2850 cm−1 and the second wavelength range to be in a range of 1165-650 cm−1, in particular of 772 to 650 cm−1. In other words, one of the two heating zones (e.g. the first heating zone) is designed to emit IR radiation in a wavelength range of 3700 to 2850 cm−1 and the other of the two heating zones (e.g. the second heating zone) is designed to emit IR radiation in a wavelength range of 1165 to 650 cm−1. The two heating zones are therefore designed such that the first heating zone can be assigned to a first main absorption (e.g. main absorption of the C—H bindings) and the second heating zone can be assigned to a second main absorption (e.g. main absorption of the O—H bindings).

According to another embodiment of the present invention, the first and the second heating zone can be activated separately. By separately activating the two heating zones of the heating element arrangement, the time cycle of the cooking and/or browning processes can be divided, for instance, so that the food result can be improved. It shall be understood by the average person skilled in the art that a separate activation of the two heating zones is not absolute necessary, since the different cooking and/or browning states already takes place in defined wavelength ranges by emitting IR radiation. Activating is in particular to be understood to mean activation of the heating elements by a controller, circuit and suchlike.

For instance, in the case of baking pastries, a heating ("rising") and then browning ("crust formation") could take place. By contrast, when grilling meat, provision could be made, for instance, for just the heating zone provided for browning the meat to be used. It shall be understood that the food is naturally also heated when the emphasis is on the browning. This applies analogously when the emphasis is on heating the food, wherein a browning is likewise achieved. It is therefore clear that the inventive heating element arrangement can intensify a heating and/or browning effect, without completely inhibiting one of the two.

As a result, different methods can be used to cook food, wherein one selection of the corresponding heating zone (e.g. first heating zone and/or second heating zone) which is adjusted to the respective food can be made as a function of a specific time of the respectively activated heating zone and/or a (pre)programmed program sequence.

According to a further embodiment of the present invention, provision is made for the first heating zone to have a first material emitting in the first wavelength range and the second heating zone to have a second material emitting in the second wavelength range. IR radiation can be emitted with different wavelength ranges by using different materials. Allowances can therefore be made for the different main absorptions for the heating and browning on account of the material selection.

According to another embodiment of the present invention, the first material at least partially forms a surface of the first heating zone and the second material at least partially forms a surface of the second heating zone. The surfaces each face a food located in the cooking compartment, so that an optimal emission of the respective IR radiation can be ensured.

Provision is preferably made for the surface of the first heating zone to be formed by a first coating and/or the surface of the second heating zone to be formed by a second coating. Very thin and resistant layers can advantageously be realized by means of a coating. Surfaces which emit IR radiation in different wavelength ranges can be realized by the coatings.

According to a further embodiment of the present invention, the heating element arrangement is formed by a surface heating element with a plurality of first and second heating zones. A surface heating element has for instance the advantage that it can be easily cleaned. The surface heating element can alternatively also be designed as a cooking compartment divider, so that it can be slid into guide rails formed in side walls of a cooking compartment muffle. It shall be understood that in this case too electrical terminals are provided to supply power to the cooking compartment divider, in order to establish electrical contact with a controller or suchlike, so that this can be operated.

The heating zones of the surface heating element are preferably distributed uniformly and alternately across the entire surface of the same. This distribution is ideally to be kept as small as possible, so that a uniform surface distribution is achieved for the surface heating element for each of the two IR radiation types. In this context, a checkerboard-type and/or strip-type arrangement pattern of the first and second heating zones is conceivable for instance. It is essential that a uniform irradiation of the food can take place even during operation of just one of the two heating zones.

According to one embodiment of the present invention, provision is made for the plurality of first heating zones to have a first heating element and the plurality of second heating zones to have a second heating element. In other words, a first heating element (heating circuit 1), which is assigned to the plurality of first heating zones, and a second heating element (heating circuit 2), which is assigned to the plurality of second heating zones, are provided. Therefore, viewed in the cross-section, the surface heating element has the first and second heating zones arranged adjacent to one another and alternatively for instance. When viewing an individual heating zone (first or second heating zone) in the cross-section, the respective heating zone is formed by a substrate (carrier), on the bottom side of which, which faces the food, a coating (first or second coating) for emitting IR radiation in a defined wavelength range is provided, and at/on the top side of which a heating element for heating the coating arranged or disposed therebelow in each case is arranged. Provision can also be made for the heating element to be arranged in the substrate.

According to a further embodiment of the present invention, the first heating element and/or the second heating element is/are arranged in a rod- and/or spiral- and/or meander-shaped manner, for instance in the form of a double spiral or double meander. As a result, a uniform heat input can be achieved by the respective heating elements into the corresponding heating zones. The heating element can be any apparatus for heating the heating zones. For instance, a resistance wire and suchlike can be provided as a heating element. It is also conceivable however for a heating apparatus with carbon nanotubes or suchlike to be used as a heating element.

Provision can be made for the first heating zone and the second heating zone to be thermally decoupled from one another by means of a decoupling means. As a result, it is advantageously possible to prevent an increased quantity of heat from being introduced into adjacent heating zones when a specific heating zone is heated. The decoupling means is preferably formed by at least one gap in a substrate of the surface heating element. In such cases, the decoupling means, in particular the gap, can be formed both on the top side and also the bottom side of the substrate or on both. Furthermore, an interruption in the substrate can also be provided in sections.

The surface of the first heating zone and the surface of the second heating zone are preferably produced by means of a surface coating method, in particular by means of thermal spraying. Advantageously the use of thermal spray technology permits a high design freedom with respect to the proportionate surface design of the differently emitting surface with respect to the entire surface of the heating element arrangement. The production is carried out here for instance by alternately masking and coating using different coating materials.

According to an alternative embodiment, the heating element arrangement is formed by at least one tubular heating element. In this case, the tubular heating element can have different coatings, for instance, for emitting IR radiation with different wavelength ranges. Two tubular heating elements are preferably provided, however, which form the first and the second heating zone. In the case of the tubular heating elements, it shall be understood that no additional heating elements have to be provided. In other words, the heating element arrangement formed as tubular heating elements simultaneously represents the heating element and the heating zone.

The tubular elements can for their part be arranged in a rod- and/or spiral- and/or meander-shaped manner. For instance, it is conceivable for the two tubular heating elements to be embodied in the form of a double spiral or a double meander. Furthermore, it shall be understood that the emission of IR radiation can be achieved with different wavelength ranges by different materials and/or different coatings.

According to the invention, a cooking appliance with an afore-described heating element arrangement is likewise included. Here the heating element arrangement preferably extends substantially across the entire surface of a muffle cover of the cooking appliance. This achieves a uniform distribution of the respective types of radiation.

Further features of the invention become apparent from the claims, the figures and the description of the figures. The features and combinations of features cited above in the description as well as the features and combinations of features cited below in the description of the figures and/or shown solely in the figures cannot only be used in the respectively specified combination, but also too in other combinations or alone, without departing from the scope of the invention.

BRIEF DESCRIPTION OF THE DRAWINGS

The above and further features of the present invention are now described in detail with respect to certain exemplary embodiments, which are shown by appended drawings and which below only serve for clarification and are thus not restrictive to the present invention. In the drawings.

Figure 1:
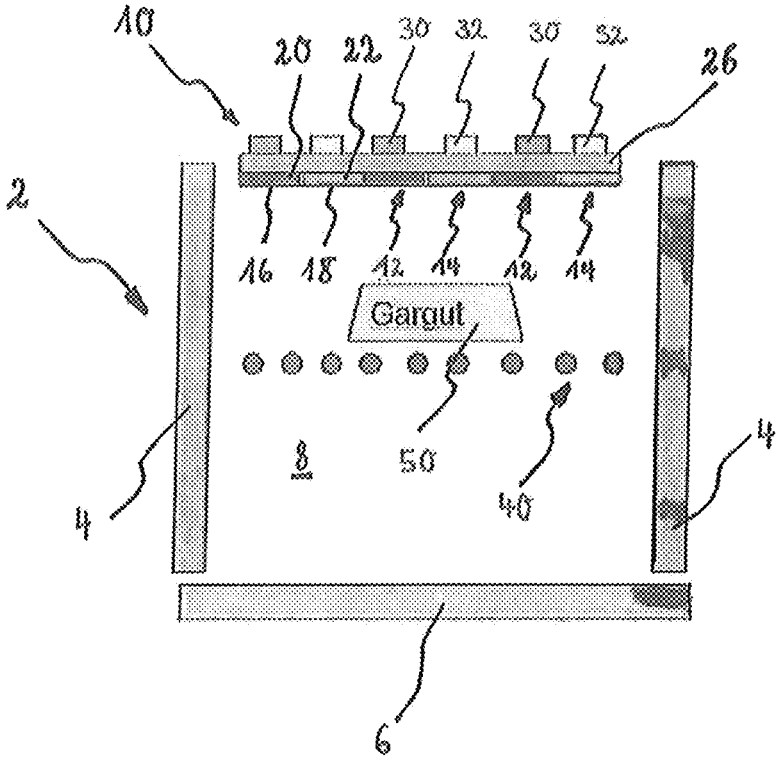
FIG. 1 shows a schematic sectional representation of a cooking appliance with a heating element arrangement according to an exemplary embodiment of the present invention.

It should be noted that the appended drawings are not necessarily true to scale and represent a somewhat simplified representation of various preferred features which serve to illustrate the fundamentals of the invention. The specific design features of the present invention, as they are disclosed herein, including e.g. specific dimensions, orientations, installation sites and shapes, are determined in part by the application provided separately herefor and the working environment. In particular, the thicknesses of coatings etc. are shown exaggerated, for clarification purposes.

Elements which are the same or function the same are provided with the same reference characters in the figures.

DETAILED DESCRIPTION OF THE FIGURES

Exemplary embodiments of the present invention are described in detail below with reference to the appended drawings.

FIG. 1 shows a simplified schematic sectional representation of a cooking appliance with a heating element arrangement 10 according to an exemplary embodiment of the present invention in a front view. The cooking appliance has a cooking compartment 8, which is delimited by a muffle 2, wherein a loading opening is embodied on the front panel. A food 50 can be introduced into the cooking compartment 8 and prepared, wherein the food 50 can be positioned on a food carrier 40. The muffle 2 is formed by opposing side walls 4, a base 6 and cover (not shown) and a rear wall (not shown).

A heating element arrangement 10 formed as a surface heating element with a plurality of first and second heating zones 12 and 14 is arranged in an upper region of the muffle 2 for heating or grilling food 50. The first heating zones 12 are designed to emit IR radiation in a first wavelength range (L1) and the second heating zones 14 are designed to emit IR radiation in a second wavelength range (L2). The first wavelength range (L1) and the second wavelength range (L2) differ from one another.

In the concrete instance, three first heating zones 12 and three second heating zones 14 are provided unrestrictedly. The plurality of first heating zones 12 has a first heating element 30 and the plurality of second heating zones 14 has a second heating element 32, so that during operation of the cooking appliance, the plurality of first heating zones 12 and the plurality of second heating zones 14 can be operated independently of one another with a first heating element 30 (heating circuit 1) and with a second heating element (heating circuit 2), in each instance.

The first heating zones 12 are each designed such that a heating element 30 is provided on a top side of a subsection of a substrate 26 and a first coating 20 for emitting IR radiation in a first wavelength range (L1) is provided on its bottom side which faces the food 50. The second heating zones 14 are each designed such that a second heating element 32 is provided on a top side of a subsection of the substrate 26 and a second coating 22 for emitting IR radiation in a second wavelength range (L2) is provided on its bottom side. The first and the second coating 20 and 22 thus form the surface 16 of the first heating zone 12 or the surface 18 of the second heating zone 14.

The two heating zones 12 and 14 can be activated separately by means of a controller (not shown). As a function of the type of controller carried out, both heating zones 12 and 14 or also just one of the two can therefore be operated. As a result, the cooking and browning processes can be controlled better and more easily.

The first and second coating 20 and 22 which form the surfaces 16 and 18 of the heating zones 12 and 14 are produced by means of a surface coating method, in particular by means of thermal spraying, and have different coating materials.

Figure 2A:
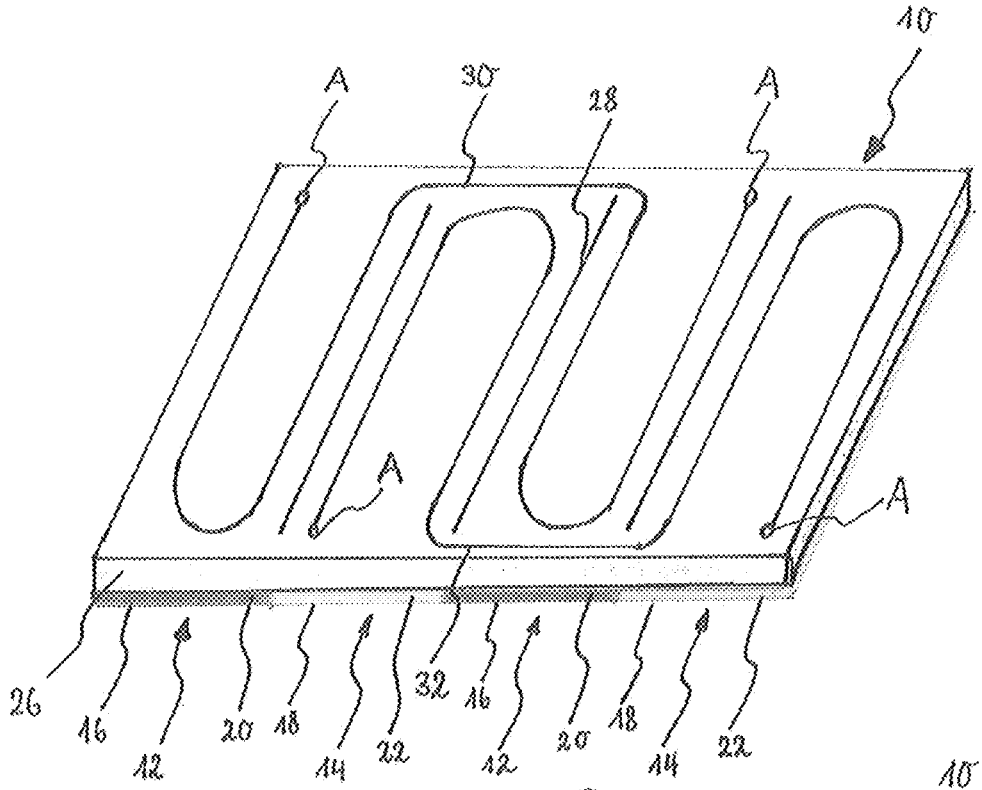
FIG. 2A shows a perspective view, which schematically represents the heating element arrangement according to a further exemplary embodiment of the present invention.

FIG. 2A shows a perspective view, which schematically represents a heating element arrangement according to a further exemplary embodiment of the present invention. The heating element arrangement 10 likewise formed as a surface heating element corresponds substantially to the surface heating element shown in FIG. 1 and only differs in that instead of in each case three first and second heating zones 12 and 14, for the sake of simplicity only two first heating zones 12 and two second heating zones 14 are shown in each case.

It is clear from FIG. 2A that the first heating element 30 and the second heating element 32 are arranged in the form of a double meander. A gap 28 is provided in the substrate 26 between the first heating element 30 and the second heating element 32, in order to thermally decouple the two heating elements 30 and 32 from one another. Viewed cross-sectionally, the first heating element 30 is arranged substantially above a first coating 20 and the second heating element 32 is arranged substantially above a second coating 22. The first coating 20 forms a first surface 16 of the first heating zone 12 and the second coating 22 forms a second surface 18 of the second heating zone 14. The heating element arrangement has electrical terminals A for supplying power to the respective heating zones 12 and 14, it being possible to connect said terminals A to a controller (not shown) or suchlike.

Figure 2B:
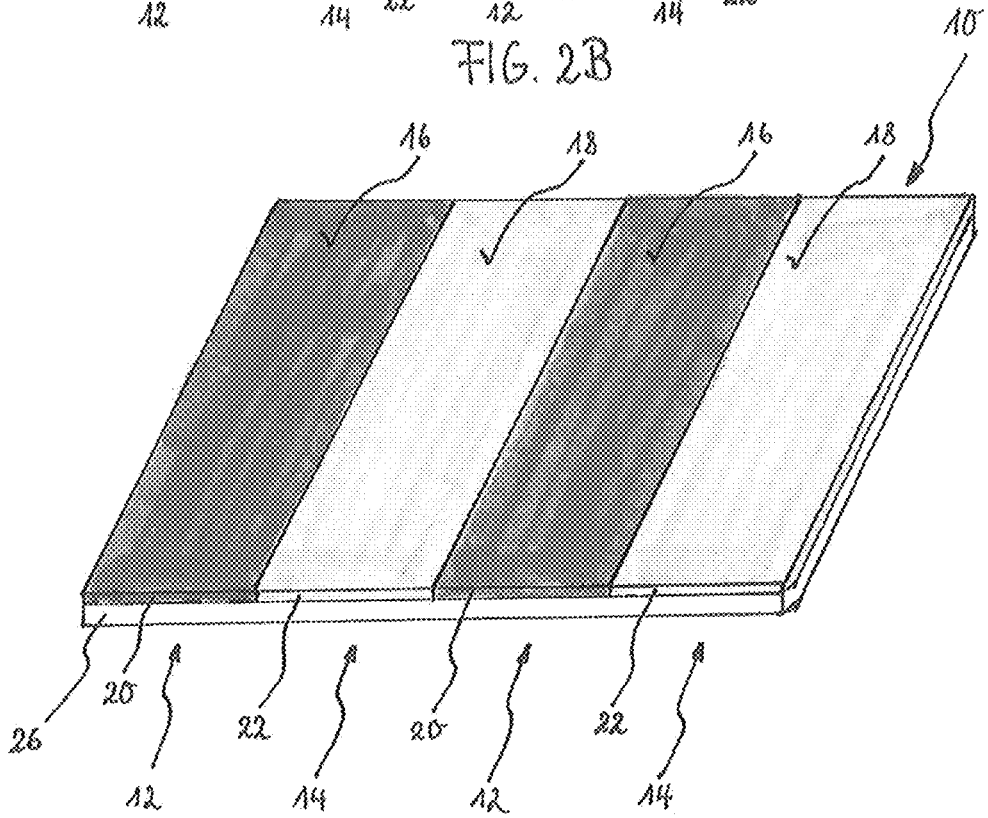
FIG. 2B shows a perspective view which schematically represents the bottom side of the heating element arrangement in FIG. 2B.

FIG. 2B shows a perspective view, which schematically represents the bottom side of the heating element arrangement in FIG. 2B. It can be seen from FIG. 2B that the first and the second coating 20 and 22 are distributed uniformly across the entire surface of the surface heating element. As a result, a uniform heating and browning of the food can be achieved. In the present case, the two coatings 20 and 22 are provided alternately in the form of strips on the substrate 26.

LIST OF REFERENCE CHARACTERS

2 muffle
4 side wall
6 base
9 cooking compartment
10 heating element arrangement
12 first heating zone
14 second heating zone
16 surface heating zone 1
18 surface heating zone 2
20 first coating
22 second coating
26 substrate
28 gap
30 first heating element
32 second heating element
40 food carrier
50 food
L1 first wavelength range
L2 second wavelength range
A terminals

The invention claimed is:

1. A heating element arrangement for a cooking appliance, comprising:

a plurality of first heating surfaces configured to be heated by a same first heating element, wherein each of the first heating surfaces has a respective coating comprising a first material configured to emit infrared (IR) radiation in a first wavenumber range when heated by the first heating element; and a plurality of second heating surfaces configured to be heated by a same second heating element, wherein each of the second heating surfaces has a respective coating comprising a second material configured to emit IR radiation in a second wavenumber range when heated by the second heating element;

wherein the first heating surfaces and the second heating surfaces are disposed adjacent each other in an alternating pattern, such that the first heating surfaces and second heating surfaces are uniformly distributed in the heating element arrangement.

2. The heating element arrangement of claim 1, wherein the heating element arrangement is configured to extend across a muffle cover.

3. The heating element arrangement of claim 1, wherein the first wavenumber range and the second wavenumber range differ from one another do not overlap.

4. The heating element arrangement of claim 1, wherein the first wavenumber range is 3700 to 2850 $cm^{-1}$ and the second wavenumber range is in a range of 1165 to 650 $cm^{-1}$.

5. The heating element arrangement of claim 4, wherein the second wavenumber range is 772 to 650 $cm^{-1}$.

6. The heating element arrangement of claim 1, wherein the plurality of first heating surfaces and the plurality of second heating surfaces are configured to be activated separately from each other.

7. The heating element arrangement of claim 1, wherein at least one of the first heating element and the second heating element has at least a first portion having a shape selected from the group consisting of a rod shape, a spiral shape, and a meander shape.

8. The heating element arrangement of claim 1, wherein the first heating surfaces and the second heating surfaces comprise surfaces of a same substrate, and the first and second heating surfaces are thermally decoupled from one another by at least one gap in the substrate.

9. The heating element arrangement of claim 8, wherein the first and second heating elements are thermally decoupled from one another by the at least one gap.

10. The heating element arrangement of claim 1, wherein the coatings of the first and second heating surfaces comprise thermally sprayed coatings.

11. The heating element arrangement of claim 1, wherein at least one of the first heating element and the second heating element comprises a tubular heating element.

12. The heating element arrangement of claim 1, wherein the first heating surfaces each comprise first strips, the second heating surfaces each comprise second strips, and the alternating pattern comprises alternating first and second strips.

13. A cooking appliance comprising:

a heating substrate having an alternating pattern of first subsections and second subsections, wherein each of the first subsections has a respective first coating configured to emit first IR radiation in a first wavenumber range, and each of the second subsections has a respective second coating configured to emit second IR radiation in a second wavenumber range;

a first heating circuit having a plurality of first heating element portions, wherein each of the first heating element portions is disposed adjacent one of the first subsections; and a second heating circuit having a plurality of second heating element portions, wherein each of the second heating element portions is disposed adjacent one of the second subsections.

14. The cooking appliance of claim 13, wherein the heating substrate is configured to extend across a wall of a cooking compartment of the appliance, with the first and second coatings facing into the cooking compartment.

15. The cooking appliance of claim 14, wherein the first and second subsections are uniformly distributed in the alternating pattern, such that food within the cooking compartment is irradiatable uniformly by the first IR radiation and irradiatable uniformly by the second IR radiation.

16. The cooking appliance of claim 13, wherein the plurality of first heating element portions comprise portions of a same first heating element, and the plurality of second heating element portions comprise portions of a same second heating element.

17. The cooking appliance of claim 13, wherein the first and second wavenumber ranges do not overlap.

18. A heating element arrangement for a cooking appliance, comprising:

a substrate having a first side including an alternating pattern of first zones defined by respective first coatings and second zones defined by respective second coatings;

a first heating element arranged on a second side of the substrate such that the first heating element is configured to heat each of the first zones; and a second heating element arranged on the second side of the substrate such that the second heating element is configured to heat each of the second zones;

wherein the first coatings are each configured to emit IR radiation in a first wavenumber range, and the second coatings are each configured to emit IR radiation in a second wavenumber range.

19. The heating element arrangement of claim 18, wherein the first and second zones are uniformly distributed on the first side of the substrate in the alternating pattern.

20. The heating element arrangement of claim 18, wherein the first and second wavenumber ranges do not overlap.

* * * * *